US007286029B2

(12) United States Patent
Joodaki

(10) Patent No.: US 7,286,029 B2
(45) Date of Patent: Oct. 23, 2007

(54) PASSIVE DEVICES FORMED IN GROOVES ON A SUBSTRATE AND A METHOD OF MANUFACTURE

(75) Inventor: Mojtaba Joodaki, Munich (DE)

(73) Assignee: ATMEL Germany GmbH, Heilbronn (DE)

( * ) Notice: Subject to any disclaimer, the term of this patent is extended or adjusted under 35 U.S.C. 154(b) by 69 days.

(21) Appl. No.: 11/122,009

(22) Filed: May 5, 2005

(65) Prior Publication Data

US 2005/0248422 A1 Nov. 10, 2005

(30) Foreign Application Priority Data

May 5, 2004 (DE) ..... 10 2004 022 176

(51) Int. Cl.
*H01P 3/08* (2006.01)

(52) U.S. Cl. ..... 333/238; 257/664

(58) Field of Classification Search ..... 333/238, 333/246; 257/664
See application file for complete search history.

(56) References Cited

U.S. PATENT DOCUMENTS 5,095,357 A 3/1992 Andoh et al.
5,196,395 A * 3/1993 James et al. ..... 505/329
5,204,280 A 4/1993 Dhong et al.
5,336,921 A 8/1994 Sundaram et al.
5,652,557 A * 7/1997 Ishikawa ..... 333/243
6,693,320 B1 2/2004 DeBoer et al.
2002/0197874 A1 12/2002 Divakaruni et al.

FOREIGN PATENT DOCUMENTS

EP 0 391 123 A2 10/1990
JP 2000-235989 A 8/2000

* cited by examiner

*Primary Examiner*—Benny Lee
(74) *Attorney, Agent, or Firm*—McGrath, Geissler, Olds & Richardson

(57) ABSTRACT

A method for constructing passive devices on a substrate and a device is provided that is fabricated in accordance with the a method. The method includes the steps of: forming a plurality of grooves on a surface of the substrate by using an anisotropic etching procedure to enlarge a surface area of the substrate; forming an insulating layer at least in the plurality of grooves; and a structured metallization at least in the plurality of grooves for constructing the device above the insulating layer such that for a maximum integration density, the passive device is essentially constructed to extend through the plurality of grooves.

22 Claims, 2 Drawing Sheets

PASSIVE DEVICES FORMED IN GROOVES ON A SUBSTRATE AND A METHOD OF MANUFACTURE

This nonprovisional application claims priority under 35 U.S.C. § 119(a) on German Patent Application No. DE 102004022176.6, which was filed in Germany on May 5, 2004, and which is herein incorporated by reference.

BACKGROUND OF THE INVENTION

1. Field of the Invention

The present invention relates to a method for constructing passive devices on a substrate and a device that is fabricated in accordance with such a method.

Although applicable to any passive device, the present invention and the problems it is based on is described in detail with regard to coils and coplanar wave guides located on a carrier substrate.

2. Description of the Background Art

In recent years, mobile as well as wireless transmission technologies have become more and more important. Therefore, a greater integration of components in the radio frequency and microwave field are desirable, whereby the cost and the size of the components are to be reduced. Known are silicon-based integrated circuits on, for example, a silicon substrate. Currently, the dimensions of the microprocessors are basically determined by the size of the passive devices and less by the size of the active devices. The demands in regard to the size of the microprocessors, that is, the integrated circuits and the devices provided thereon continue to increase so that new construction methods for dimension optimization are being explored.

SUMMARY OF THE INVENTION

It is therefore an object of the present invention to provide a method for constructing passive devices on a substrate and a component that is fabricated in accordance with such a method, whereby in a simple way, a degree of spatial efficiency, that is, an integration density of a passive device is increased, whereby a device can be constructed on the substrate such that a smaller surface area of the carrier substrate is required while the performance level remains the same, or that the number of devices that are placed on a surface unit can be increased.

The present invention is based on the idea to enlarge a surface of the carrier substrate by forming grooves utilizing an anisotropic etching procedure, and to construct, at least partially, devices having such a structure and geometry on the surface of the substrate and in the formed grooves. To this end, the method of the present invention can include the following steps: forming a plurality of grooves on a surface of the substrate utilizing an anisotropic etching procedure to enlarge the surface of the substrate; forming an insulating layer at least in the plurality of grooves; and structured metallization at least in the plurality of grooves for construction of the device above the insulating layer such that the passive device extending through the plurality of grooves is essentially constructed for optimal integration density.

Compared to conventional technology, the present invention has the advantage that in a simple way by applying a standard etching procedure, the substrate surface is achieved by forming grooves so that the number, that is, integration density of the passive devices on a substrate of predefined size is increased. In other words, the surface area of the substrate that is actually taken up by passive devices is reduced without affecting the performance capability, so that a plurality of devices can be arranged on a predefined substrate.

According to an example embodiment, several grooves are formed on the surface of the substrate by applying an anisotropic wet chemical etching method, whereby the grooves preferably have a trench-shaped structure due to the anisotropic nature of the etching procedure, and their longitudinal axes are preferably structured roughly in parallel to one another.

For example, three conductors, two ground conductors and one signal conductor, are formed parallel to one another and vertical to the longitudinal direction of the trench-shaped grooves by the structured metallization on the substrate and at least partially in the grooves for constructing a coplanar waveguide, whereby the dielectric layer serves as a dividier, that is, an intermediate layer between the substrate and the metallization. Alternatively, or additionally, a coil, for example, a spiral-shaped coil, can be formed by the structured metallization on the substrate, whereby, in particular, at least one segment of the coil is parallel to, and at least one segment of the coil is vertical to the longitudinal extension of the trench-shaped grooves. In a further method step, a bridge connection for a suitable connection of the, for example, spiral-shaped coil can be established. Thus, the present invention provides in a simple way passive devices, for example, a coplanar waveguide, a coil, an MIM condenser, a T-connection, contact points, or the like on the substrate and at least partially in the grooves, whereby the actual enlargement of the substrate surface, that is, an increase in the integration density due to a simple anisotropic wet chemical etching process, is made use of.

In particular, a KOH etching agent with the addition of, for example, a silicon nitride mask, is used in the anisotropic etching procedure for forming the trenches.

Preferably, the insulating layer is made of a dielectric organic insulation material, for example, a polyimide, an SU-8 material, a SiLK resin, an organic polymer material, for example, benzocyclobutene (BBC), or the like.

The photoresist layer can preferably be a positive or a negative photoresist and can be formed over the dielectric insulating layer using a conventional deposition method. It is beneficial to smooth out the convex corner areas of the trenches using, for example, a TM AH solution prior to forming the photoresist layer over the substrate, that is, the dielectric insulating layer and in the trenches to ensure a more stable application of the photoresist coat.

The substrate can be constructed as a silicon semiconductor substrate, a germanium-silicon substrate, or the like. The metallization are preferably made of aluminum, copper, silver, gold, titanium, or the like. Due to its high mechanical durability and low electrical resistance, aluminum has proven to be particularly well suited.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1B:
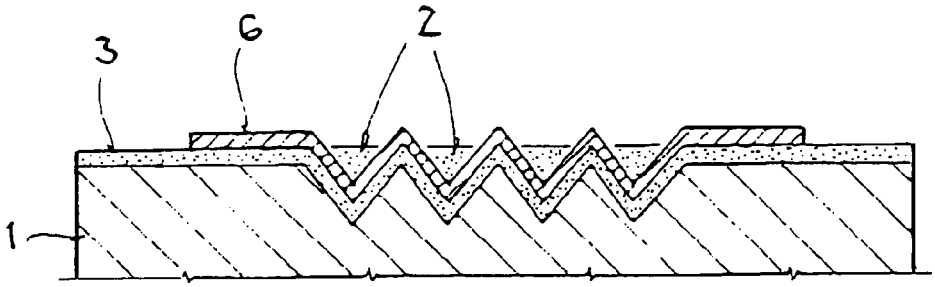
FIG. 1*b* is a cross-sectional view of the coplanar wave guide constructed on the substrate, along line A-A in FIG. 1*a;*

Identical reference numerals in the figures designate substantially identical components, or components with substantially identical functions, unless indicated otherwise.

Figure 1A:
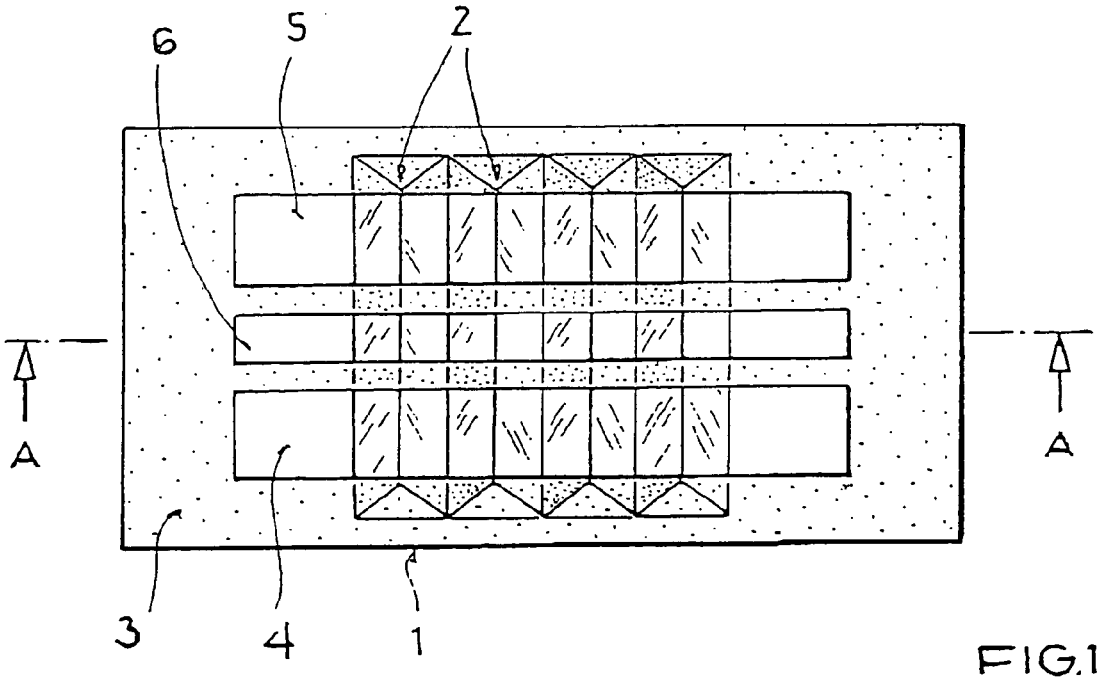
FIG. 1*a* is a top view of a coplanar wave guide according to an embodiment of the present invention, which is constructed on a substrate in accordance with a method of the present invention.

FIG. 1*a* illustrates a top view and FIG. 1*b* a cross-sectional view along the line A-A of FIG. 1*a* of a coplanar wave guide, which is constructed on a substrate 1 according to a production method of an embodiment of the present invention.

Starting with a carrier substrate 1, for example, a silicon substrate, a silicon-germanium substrate, or the like, the surface of the substrate 1 is subjected to a surface treatment using an anisotropic wet chemical etching procedure.

For example, grooves 2 having oblique walls and being suitably structured and positioned to one another, are formed in predefined areas on the surface of the substrate 1 by applying a KOH etching solution and adding a silicon-nitride mask due to the anisotropic nature of the etching process, as can particularly seen in FIG. 1*b*. For example, a plurality of grooves 2 is formed on the surface of the substrate 1, which are trench-shaped, and the longitudinal axes of which are arranged in parallel to one another, as is illustrated in FIGS. 1*a* and 1*b*. In this way, a systematic surface enlargement of the substrate 1 is achieved by using a simple anisotropic, wet chemical etching method.

In order to achieve better uniformity of the subsequent layer over the convex corner areas of the grooves 2, the convex areas are smoothed out over a predefined period of time, for example, with a TM AH solution, or the like.

Subsequently, the surface of the substrate 1 and the surface of the grooves 2 are preferably coated with a dielectric insulating layer 3. The dielectric insulating layer 3 is evenly deposited over the entire surface of the substrate 1 and the grooves 2 using, for example, a spin-coating method, and is hardened by a heat treatment, for example. The dielectric insulating layer 3 is made, for example, of an organic insulation material. Polyimide and SU-8 have proven to be particularly suitable. However, it is noted at this point that other materials, for example, an organic polymer, particularly benzocyclobutene (BBC), a SiLK material, or the like can also be used.

The dielectric insulating layer 3 preferably serves as an intermediate layer between the later applied coplanar waveguide metallization 4, 5, and 6, as illustrated, for example, in FIGS. 1*a* and 1*b,* and the substrate 1 so that coupling and substrate losses can be reduced. For example, the polyimide DuPont P12734-polyimide, which is a negative photosensitive material, can be used for the dielectric insulating layer 3. By exposure, and due to a structure change, this photosensitive material can be solidly formed on the surface of the substrate 1 and on the surface of the grooves 2. It will be obvious to one skilled in the art that in an analogous manner, positive photosensitive materials can be used, whereby vice versa the non-exposed segments firmly bond with the surface of the substrate 1 and the surface of the grooves 2.

Next, a photoresist layer (not illustrated) is applied over the dielectric insulating layer 3, which serves as a mask for the subsequent structured coplanar waveguide metallization. The photoresist layer can be a positive or a negative photolacquer and can be applied over the dielectric insulating layer 3 using particularly two different methods.

A feasible method is to provide the substrate with an electrical connection so that from an aqueous solution, including the photoresist material, a deposition occurs. The so-called electro-deposition is self-determining, that is, the current on the substrate surface decreases with increasing thickness of the already deposited photoresist layer, thereby causing the deposition to automatically drop down to zero. In this way, an extremely uniform photoresist layer over the entire surface of the substrate 1 and over the entire surface of the trenches 2 is achieved.

As an alternative, a conventional method for applying the photoresist layer to the surface of the substrate 1 and the surface of the grooves 2 can be used. The surface is thereby evenly coated with the photoresist material by rotating the substrate 1 in a saturated solution. In order to further improve this coating, the convex corner regions can be pre-smoothed with a TM AH solution, as previously described. Since the concave corner regions on the bottom of the grooves 2 are uniformly coated with the photoresist material, the dielectric insulating layer 3 is also applied over the concave corner areas beforehand, as shown in FIG. 1*b*. With the dielectric insulating layer 3 being applied over the grooves 2, an additional smoothness of the concave corner regions of the respective grooves 2 is achieved.

For example, the photoresist material AZ 4562 can be used, which is used to form the mask for the subsequent metallization.

As is further illustrated in FIGS. 1*a* and 1*b,* a coplanar waveguide metallization that is suitably structured by utilizing the photoresist layer serving as a mask is then formed on defined areas of the surface of the substrate 1 and at least partially on the surface of the grooves 2 by using a conventional metallization method.

According to the preferred embodiment in FIGS. 1*a* and 1*b,* a signal conductor 6 and two ground conductors 4 and 5 (see, for example, FIG. 1*a*) are formed on the surface of the pattern, whereby the individual conductors 4, 5 and 6 are preferably arranged in parallel to and spaced apart from one another. Preferably, the conductors 4, 5, and 6 extend perpendicular to the longitudinal axis of the grooves 2, as is illustrated in FIG. 1*a*. In this way, the surface enlargement of the substrate 1 due to the grooves 2 is most suitably utilized, that is, the integration density of the structure is maximized.

The coplanar waveguide metallization 4, 5, and 6 can be made, for example, of aluminum, copper, silver, gold, titanium, or the like. Aluminum has proven to be particularly beneficial due to its high electrical conductivity, high degree of robustness, and the fact that it connects well with, for example, an SU-8 insulation material 3.

Thus, the present invention provides a simple production method for a stable coplanar waveguide system on a substrate, which has a greater integration density than a conventional coplanar waveguide system.

Figure 2B:
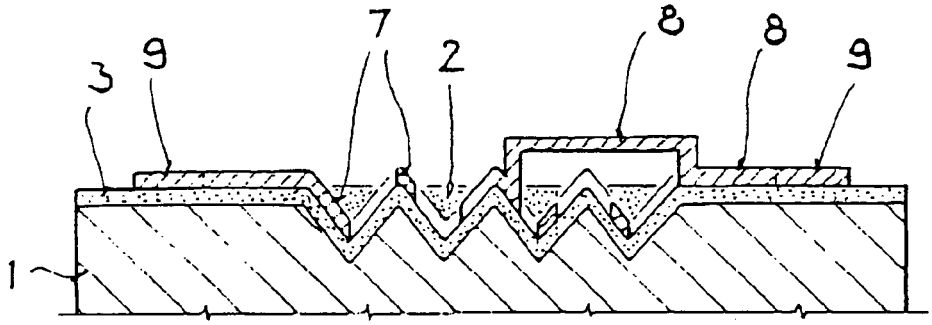
FIG. 2*b* is a cross-sectional view of the spiral coil constructed on the substrate, along line B-B in FIG. 2*a*.
Figure 2A:
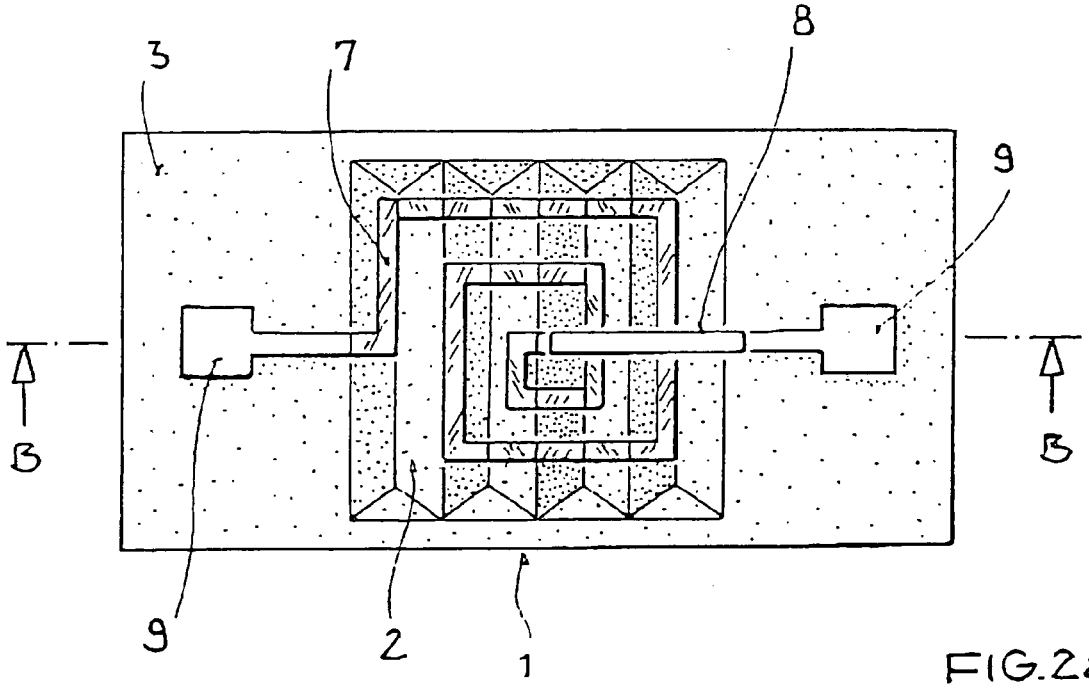
FIG. 2*a* is a top view of a spiral-shaped coil according to an embodiment of the present invention, which is constructed on a substrate in accordance with a method of the present invention.

FIG. 2*a* illustrates a top view, and FIG. 2*b* illustrates a cross-sectional view along the line B-B in FIG. 2*a* of an exemplary helical coil, which is constructed on a substrate 1 using a method according to an embodiment of the present invention.

With regard to the construction of the grooves 2, the dielectric insulating layer 3 as well as the metallization with the addition of a photoresist layer, reference is made to the first embodiment according to FIGS. 1*a* and 1*b*. Likewise, the individual method steps and also the material selection are analogous to those previously described so that they will not be discussed in detail therebelow.

In contrast to the first embodiment according to FIGS. 1*a* and 1*b*, a metallization in the present embodiment is carried out such that a helical structure is formed on the surface of the substrate 1 and at least in part in the grooves 2, as is illustrated in FIGS. 2*a* and 2*b*. It is shown in FIG. 2*a* that the helical coil is constructed, for example, of rectangular windings, whereby the rims of the rectangular windings extend vertically to the longitudinal direction of the grooves 2 and the corresponding bordering rims of the spiral-shaped coil extend parallel to the longitudinal direction of the grooves 2. It will be obvious to one skilled in the art that different winding structures appropriate for the respective application are also feasible as long as the windings extend into the grooves 2, at least in part.

Preferably, the coil conductor 7 having a structure as is illustrated in FIG. 2*a* is formed on the substrate and at least partially in the grooves 2, whereby, for example, on two opposing sides of the coil, contact areas 9 on the surface of the substrate 1 are metallized.

Additionally, a bridge connection 8 is provided, which connects, for example, a contact area 9 with the inner end of the coil for an electrical connection.

Thus, the present invention provides a simple production method for an efficient coil on a substrate having a higher integration density on a substrate than conventional coils.

Although the present invention has been described with reference to preferred embodiments, it is not limited thereto and can be modified in many ways.

For example, apart from coplanar wave guides and coils, all passive devices can be constructed by using the method of the present invention as described above, for example, MIM condensers, T-connections, ports, or the like.

It will also be obvious to one skilled in the art that different materials can be used for the substrate, the dielectric layer, the photoresist mask as well as for the metallization. The only deciding factor is that the surface of the substrate is magnified by using a simple anisotropic etching procedure to provide a passive device with a higher integration density.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for constructing a passive device on a substrate, the method comprising the steps of:

forming a plurality of grooves on a surface of the substrate by using a anisotropic etching procedure to enlarge a surface area of the substrate;

forming an insulating layer at least in the plurality of grooves; and structured metallizing at least in the plurality of grooves for constructing the passive device on an upper surface of the insulating layer such that the passive device is constructed to extend across the plurality of grooves to maximize integration density thereof.

2. The method according to claim 1, wherein the plurality of grooves are formed as parallel trenches on the surface of the substrate by using an anisotropic wet chemical procedure.

3. The method according to claim 2, wherein, for the anisotropic wet chemical etching procedure, a KOH etching agent is used utilizing a silicon-nitride mask.

4. The method according to claim 1, further comprising a helical metallization for forming a coil over the insulating layer and at least partially in the grooves, wherein at least one segment of the coil extends parallel to, and at least one segment of the coil extends perpendicularly to a longitudinal direction of the grooves.

5. The method according to claim 1, wherein, via a suitable metallization, a MIM condenser, a T-junction, or contact points, are formed over the insulating layer and extending at least partially into a segment of the grooves.

6. The method according to claim 1, wherein a coplanar wave guide having two ground conductors and a signal conductor are formed over the insulating layer and at least partially in the grooves, and wherein the two ground conductors and the signal conductor are arranged perpendicular to a longitudinal direction of the grooves.

7. The method according to claim 1, wherein the insulating layer is made of a dielectric organic insulation material, a polyimide, SU-8, SiLK, an organic polymer, or benzocyclobutene (BBC).

8. The method according to claim 1, wherein prior to a step of forming a photoresist mask over the insulating layer, convex corner areas of at least one of the plurality of grooves is smoothed out with a TMAH solution.

9. The method according to claim 8, wherein the photoresist mask is a positive or a negative photolack.

10. The method according to claim 8, wherein the photoresist mask is formed over the insulating layer by using an electro-deposition procedure.

11. The method according to claim 8, wherein the photoresist mask is formed over the insulating layer by using a standard deposition technique.

12. The method according to claim 1, wherein the substrate is a silicon semiconductor substrate.

13. The method according to claim 1, wherein the metallization is made of aluminum, copper, silver, gold, or titanium.

14. The method according to claim 1, wherein the passive device comprises a coplanor wave guide, a coil, or a capacitor.

15. A device comprising:

a substrate;

a plurality of grooves being formed on a surface of the substrate by an anisotropic etching procedure for increasing a surface area of the substrate;

an insulating layer being provided at least in the plurality of grooves; and a structured metallization being provided at least in the plurality of grooves for forming a passive device on an upper surface of the insulating layer such that the passive device extends across the plurality of grooves for maximizing integration density.

16. The device according to claim 15, wherein a coplanar wave guide includes a signal conductor and two ground conductors provided over the insulating layer and at least partially in the grooves, which extend perpendicular to a longitudinal direction of the grooves.

17. The device according to claim 15, wherein a spiral-shaped metallization, for forming a coil over the insulating layer and at least partially in the grooves, is provided, and wherein at least one segment of the coil extends parallel to and at least one segment of the coil extends perpendicular to a longitudinal direction of the grooves.

18. The device according to claim 15, wherein, via a metallization process, an MIM condenser, a T-junction, or contact points are provided over the insulating layer, and which at least partially extend into a segment of the grooves.

19. The device according to claim 15, wherein the insulating layer is made of a dielectric organic insulation material, a polyimide, SU-8, SiLK, an organic polymer, or benzocyclobutene (BBC).

20. The device according to claim 15, wherein the substrate is a silicon semiconductor substrate.

21. The device according to claim 15, wherein the metallization is comprised of aluminum, copper, silver, gold, or titanium.

22. The device according to claim 15, wherein the plurality of grooves are shaped as parallel trenches by using an anisotropic wet chemical etching procedure.

* * * * *